US009786222B2

(12) United States Patent
Lim et al.

(10) Patent No.: US 9,786,222 B2
(45) Date of Patent: Oct. 10, 2017

(54) PIXEL CIRCUIT AND ORGANIC LIGHT-EMITTING DIODE DISPLAY INCLUDING THE SAME

(71) Applicant: Samsung Display Co., Ltd., Yongin, Gyeonggi-Do (KR)

(72) Inventors: Jae-Keun Lim, Suwon-si (KR); Hui-Won Yang, Seoul (KR); Chong-Chul Chai, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 198 days.

(21) Appl. No.: 14/728,844

(22) Filed: Jun. 2, 2015

(65) Prior Publication Data

US 2016/0042694 A1 Feb. 11, 2016

(30) Foreign Application Priority Data

Aug. 7, 2014 (KR) ..... 10-2014-0101450

(51) Int. Cl.
*G09G 3/32* (2016.01)
*G09G 3/3233* (2016.01)

(52) U.S. Cl.
CPC ... *G09G 3/3233* (2013.01); *G09G 2300/0426* (2013.01); *G09G 2300/0814* (2013.01);
(Continued)

(58) Field of Classification Search
CPC ..... G09G 3/3233; G09G 2320/043; G09G 2310/0251; G09G 2300/0814; G09G 2300/0819; G09G 2300/0426
See application file for complete search history.

(56) References Cited

U.S. PATENT DOCUMENTS

2004/0130516 A1* 7/2004 Nathan ..... H01L 27/12 345/82
2005/0206591 A1 9/2005 Wang et al.
(Continued)

FOREIGN PATENT DOCUMENTS

KR 10-2012-0090813 A 8/2012
KR 10-2012-0135406 A 12/2012
KR 10-2014-0035156 A 3/2014

*Primary Examiner* — Temesghen Ghebretinsae
*Assistant Examiner* — Ivelisse Martinez Quiles
(74) *Attorney, Agent, or Firm* — Knobbe Martens Olson & Bear LLP

(57) ABSTRACT

A pixel circuit and an OLED display including the same are disclosed. The pixel circuit includes a driving transistor having a double gate structure, the driving transistor including a first gate electrode electrically connected to a first node, a second gate electrode electrically connected to a second node, a first electrode electrically connected to a first power supply voltage, and a second electrode electrically connected to the anode of the OLED. The pixel circuit also includes a switching transistor including a gate electrode configured to receive a scan signal, a first electrode configured to receive a data voltage, and a second electrode electrically connected to the first node. The pixel circuit further includes a storage capacitor and a compensation capacitor including a first electrode electrically connected to the second node and a second electrode electrically connected to the first electrode of the driving transistor.

16 Claims, 8 Drawing Sheets

(52) U.S. Cl.
CPC ..... *G09G 2300/0819* (2013.01); *G09G 2310/0251* (2013.01); *G09G 2320/043* (2013.01)

(56) References Cited

U.S. PATENT DOCUMENTS

2006/0027807 A1* 2/2006 Nathan ..... G09G 3/3233 257/59
2006/0119548 A1* 6/2006 Lan ..... G09G 3/3233 345/76
2007/0040770 A1* 2/2007 Kim ..... G09G 3/3233 345/76
2010/0053041 A1* 3/2010 Abe ..... G09G 3/325 345/76
2010/0220118 A1* 9/2010 Kanegae ..... G09G 3/3233 345/690
2012/0147060 A1* 6/2012 Jeong ..... G09G 3/3233 345/690
2012/0169693 A1* 7/2012 Tsai ..... G09G 3/3233 345/211
2012/0169798 A1* 7/2012 Ebisuno ..... G09G 3/325 345/690
2012/0200283 A1 8/2012 Socheat
2012/0249510 A1* 10/2012 Jankovic ..... G09G 3/3233 345/211
2013/0063413 A1* 3/2013 Miyake ..... G09G 3/32 345/212
2013/0069068 A1* 3/2013 Miyake ..... H01L 27/06 257/59
2014/0061739 A1 3/2014 Kurokawa
2014/0062331 A1* 3/2014 Nam ..... G09G 3/3233 315/226
2014/0070184 A1 3/2014 Shin
2014/0168194 A1* 6/2014 Kong ..... G09G 3/3233 345/212
2015/0243220 A1* 8/2015 Kim ..... H01L 27/1225 345/215

* cited by examiner

PIXEL CIRCUIT AND ORGANIC LIGHT-EMITTING DIODE DISPLAY INCLUDING THE SAME

CROSS-REFERENCE TO RELATED APPLICATIONS

This application claims priority from and the benefit of Korean Patent Applications No. 10-2014-0101450, filed on Aug. 7, 2014 in the Korean Intellectual Property Office (KIPO), the disclosure of which is hereby incorporated by reference herein in its entirety.

BACKGROUND

Field

The described technology generally relates to pixel circuits and organic light-emitting diode displays.

Description of the Related Technology

An organic light-emitting diode (OLED) display has favorable characteristics such as rapid response speed and low power consumption because the OLEDs self-emit light based on recombination of electrons and holes.

SUMMARY OF CERTAIN INVENTIVE ASPECTS

One inventive aspect is a pixel circuit including a driving transistor having a double gate structure.

Another aspect is an organic light-emitting diode (OLED) display including the pixel circuit.

Another aspect is a pixel circuit that comprises an organic light-emitting diode (OLED), a driving transistor having a double gate structure, the driving transistor including a first gate electrode connected to a first node, a second gate electrode connected to a second node, a first electrode connected to a first power supply voltage, and a second electrode connected to an anode of the OLED, a switching transistor including a gate electrode to which a scan signal is applied, a first electrode to which a data voltage is applied, and a second electrode connected to the first node, a storage capacitor including a first electrode connected to the first node and a second electrode connected to the first power supply voltage, and a compensation capacitor including a first electrode connected to the second node and a second electrode connected to the first electrode of the driving transistor.

In example embodiments, the pixel circuit further comprises a first initialization transistor including a gate electrode to which an initialization signal is applied, a first electrode to which a reference voltage is applied, and a second electrode connected to the second node, and an emission control transistor connected between the first power supply voltage and the first electrode of the driving transistor, the emission control transistor including a gate electrode to which an emission control signal is applied, a first electrode to which the first power supply voltage is applied, and a second electrode connected to the first electrode of the driving transistor.

In example embodiments, the first initialization transistor applies the reference voltage to the second node based at least in part on the initialization signal during a threshold voltage compensation period. The switching transistor can apply a voltage corresponding to the reference voltage to the first node based at least in part on the scan signal during the threshold voltage compensation period. The emission control transistor can be turned off during the threshold voltage compensation period such that the first electrode of the driving transistor and the second electrode of the compensation capacitor are electrically separated from the first power supply voltage.

In example embodiments, the driving transistor is electrically separated from the first power supply voltage such that a voltage of the first electrode of the driving transistor is changed to a sum of the reference voltage and a threshold voltage of the driving transistor during the threshold voltage compensation period and the threshold voltage of the driving transistor is stored in the compensation capacitor during the threshold voltage compensation period.

In example embodiments, the reference voltage is less than a voltage difference between the first power supply voltage and a threshold voltage of the driving transistor.

In example embodiments, the pixel circuit further comprises a second initialization transistor including a gate electrode to which the initialization signal is applied, a first electrode to which an initialization voltage is applied, and a second electrode connected to the anode of the OLED.

In example embodiments, the first initialization transistor applies the reference voltage to the second node based at least in part on the initialization signal during an initialization period. The second initialization transistor can apply the initialization voltage to the anode of the OLED based at least in part on the initialization signal during the initialization period.

In example embodiments, the switching transistor applies the reference voltage to the first node based at least in part on the scan signal during the initialization period.

In example embodiments, the pixel circuit further comprises a third initialization transistor including a gate electrode to which the initialization signal, a first electrode to which the reference voltage is applied, and a second electrode connected to the first node. The third initialization transistor can apply the reference voltage to the first node based at least in part on the initialization signal during the initialization period.

In example embodiments, the switching transistor applies the data voltage to the first node based at least in part on the scan signal during a data writing period.

In example embodiments, the emission control transistor is turned on based at least in part on the emission control signal during an emission period. A voltage difference between the first power supply voltage and a threshold voltage of the driving transistor can be applied to the second node by a coupling of the compensation capacitor during the emission period.

In example embodiments, the pixel circuit further comprises an emission control transistor connected between the second electrode of the driving transistor and the anode of the OLED, the emission control transistor including a gate electrode to which an emission control signal is applied, a first electrode connected to the second electrode of the driving transistor, and a second electrode connected to the anode of the OLED, a first initialization transistor including a gate electrode to which an initialization signal is applied, a first electrode to which a reference voltage is applied, and a second electrode connected to the second node, a second initialization transistor including a gate electrode to which the initialization signal is applied, a first electrode to which the reference voltage is applied, and a second electrode connected to the first node, and a compensation transistor connected between the second electrode of the driving transistor and the second node.

In example embodiments, the compensation transistor is turned on based at least in part on the scan signal during a data writing period such that the driving transistor is diode-connected. A threshold voltage of the driving transistor can be stored in the compensation capacitor during the data writing period.

In example embodiments, the pixel circuit further comprises a third initialization transistor including a gate electrode to which the initialization signal is applied, a first electrode to which an initialization voltage is applied, and a second electrode connected to the anode of the OLED.

Another aspect is an OLED display that comprises a display panel including a plurality of pixel circuits, a scan driver applying a scan signal and an initialization signal to the display panel, a data driver applying a data voltage to the display panel, and an emission driver applying an emission control signal to the display panel. Each of the pixel circuits includes an OLED, a driving transistor having a double gate structure, the driving transistor including a first gate electrode connected to a first node, a second gate electrode connected to a second node, a first electrode connected to a first power supply voltage, and a second electrode connected to an anode of the OLED, a switching transistor including a gate electrode to which a scan signal is applied, a first electrode to which a data voltage is applied, and a second electrode connected to the first node, a storage capacitor including a first electrode connected to the first node and a second electrode connected to the first power supply voltage, and a compensation capacitor including a first electrode connected to the second node and a second electrode connected to the first electrode of the driving transistor.

In example embodiments, each of the pixel circuits further includes a first initialization transistor including a gate electrode to which the initialization signal is applied, a first electrode to which a reference voltage is applied, and a second electrode connected to the second node, and an emission control transistor connected between the first power supply voltage and the first electrode of the driving transistor, the emission control transistor including a gate electrode to which an emission control signal is applied, a first electrode to which the first power supply voltage is applied, and a second electrode connected to the first electrode of the driving transistor.

In example embodiments, each of the pixel circuits further includes a second initialization transistor including a gate electrode to which the initialization signal is applied, a first electrode to which an initialization voltage is applied, and a second electrode connected to the anode of the OLED, and a third initialization transistor including a gate electrode to which the initialization signal is applied, a first electrode to which the initialization signal is applied, and a second electrode connected to the first node.

In example embodiments, the first initialization transistor applies the reference voltage to the second node based at least in part on the initialization signal during a threshold voltage compensation period. The emission control transistor can be turned off during the threshold voltage compensation period such that the first electrode of the driving transistor and the second electrode of the compensation capacitor are electrically separated from the first power supply voltage.

In example embodiments, the driving transistor is electrically separated from the first power supply voltage such that a voltage of the first electrode of the driving transistor is changed to sum of the reference voltage and a threshold voltage of the driving transistor during the threshold voltage compensation period and the threshold voltage of the driving transistor is stored in the compensation capacitor during the threshold voltage compensation period.

In example embodiments, the first initialization transistor applies the reference voltage to the second node based at least in part on the initialization signal during an initialization period. The second initialization transistor can apply the initialization voltage to the anode of the OLED based at least in part on the initialization signal during the initialization period. The third initialization transistor can apply the reference voltage to the first node based at least in part on the initialization signal during the initialization period.

Another aspect is a pixel circuit for an organic light-emitting diode (OLED) display comprising an OLED and a driving transistor having a double gate structure. The driving transistor comprises a first gate electrode electrically connected to a first node, a second gate electrode electrically connected to a second node, a first electrode electrically connected to a first power supply voltage, and a second electrode electrically connected to the anode of the OLED. The pixel circuit also comprises a switching transistor including a gate electrode configured to receive a scan signal, a first electrode configured to receive a data voltage, and a second electrode electrically connected to the first node. The pixel circuit further comprises a storage capacitor including a first electrode electrically connected to the first node and a second electrode electrically connected to the first power supply voltage. The pixel circuit also comprises a compensation capacitor including a first electrode electrically connected to the second node and a second electrode electrically connected to the first electrode of the driving transistor.

The above circuit further comprises a first initialization transistor including a gate electrode configured to receive an initialization signal, a first electrode configured to receive a reference voltage, and a second electrode electrically connected to the second node. The above circuit further comprises an emission control transistor electrically connected between the first power supply voltage and the first electrode of the driving transistor, wherein the emission control transistor includes a gate electrode configured to receive an emission control signal, a first electrode configured to receive the first power supply voltage, and a second electrode electrically connected to the first electrode of the driving transistor.

In the above circuit, the first initialization transistor is configured to apply the reference voltage to the second node based at least in part on the initialization signal during a threshold voltage compensation period, wherein the switching transistor is configured to apply a voltage corresponding to the reference voltage to the first node based at least in part on the scan signal during the threshold voltage compensation period, and wherein the emission control transistor is configured to be turned off during the threshold voltage compensation period such that the first electrode of the driving transistor and the second electrode of the compensation capacitor are electrically disconnected from the first power supply voltage.

In the above circuit, during the threshold voltage compensation period, the driving transistor is electrically disconnected from the first power supply voltage such that a voltage of the first electrode of the driving transistor is configured to change to the sum of the reference voltage and a threshold voltage of the driving transistor, wherein the compensation capacitor is configured to store the threshold voltage of the driving transistor during the threshold voltage compensation period.

In the above circuit, the reference voltage is less than a voltage difference between the first power supply voltage and a threshold voltage of the driving transistor.

The above circuit further comprises a second initialization transistor including a gate electrode configured to receive the initialization signal, a first electrode configured to receive an initialization voltage, and a second electrode electrically connected to the anode of the OLED.

In the above circuit, the first initialization transistor is configured to apply the reference voltage to the second node based at least in part on the initialization signal during an initialization period, wherein the second initialization transistor is configured to apply the initialization voltage to the anode of the OLED based at least in part on the initialization signal during the initialization period.

In the above circuit, the switching transistor is configured to apply the reference voltage to the first node based at least in part on the scan signal during the initialization period.

The above circuit further comprises a third initialization transistor including a gate electrode configured to receive the initialization signal, a first electrode configured to receive the reference voltage, and a second electrode electrically connected to the first node, wherein the third initialization transistor is configured to apply the reference voltage to the first node based at least in part on the initialization signal during the initialization period.

In the above circuit, the switching transistor is configured to apply the data voltage to the first node based at least in part on the scan signal during a data writing period.

In the above circuit, the emission control transistor is configured to be turned on based at least in part on the emission control signal during an emission period, wherein the compensation capacitor is configured apply a voltage difference between the first power supply voltage and a threshold voltage of the driving transistor to the second node during the emission period.

The above circuit further comprises an emission control transistor electrically connected between the second electrode of the driving transistor and the anode of the OLED, wherein the emission control transistor includes a gate electrode configured to receive an emission control signal, a first electrode electrically connected to the second electrode of the driving transistor, and a second electrode electrically connected to the anode of the OLED. The above circuit further comprises a first initialization transistor including a gate electrode configured to receive an initialization signal, a first electrode configured to receive a reference voltage, and a second electrode electrically connected to the second node. The above circuit further comprises a second initialization transistor including a gate electrode configured to receive the initialization signal, a first electrode configured to receive the reference voltage, and a second electrode electrically connected to the first node. The above circuit further comprises a compensation transistor electrically connected between the second electrode of the driving transistor and the second node.

In the above circuit, the compensation transistor is configured to be turned on based at least in part on the scan signal during a data writing period such that the driving transistor is diode-connected, wherein the compensation capacitor is configured to store a threshold voltage of the driving transistor during the data writing period.

The above circuit further comprises a third initialization transistor including a gate electrode configured to receive the initialization signal, a first electrode configured to receive an initialization voltage, and a second electrode electrically connected to the anode of the OLED.

Another aspect is an organic light-emitting diode (OLED) display comprising a display panel including a plurality of pixel circuits, a scan driver configured to apply a scan signal and an initialization signal to the display panel, a data driver configured to apply a data voltage to the display panel, and an emission driver configured to apply an emission control signal to the display panel. Each of the pixel circuits includes an OLED, a driving transistor having a double gate structure, wherein the driving transistor comprises a first gate electrode electrically connected to a first node, a second gate electrode electrically connected to a second node, a first electrode electrically connected to a first power supply voltage, and a second electrode electrically connected to the anode of the OLED. Each of the pixel circuits includes a switching transistor including a gate electrode configured to receive a scan signal, a first electrode configured to receive a data voltage, and a second electrode electrically connected to the first node. Each of the pixel circuits includes a storage capacitor including a first electrode electrically connected to the first node and a second electrode electrically connected to the first power supply voltage. Each of the pixel circuits includes a compensation capacitor including a first electrode electrically connected to the second node and a second electrode electrically connected to the first electrode of the driving transistor.

In the above display, each of the pixel circuits further includes a first initialization transistor including a gate electrode configured to receive the initialization signal, a first electrode configured to receive a reference voltage, and a second electrode electrically connected to the second node. In the above display, each of the pixel circuits further includes an emission control transistor electrically connected between the first power supply voltage and the first electrode of the driving transistor, wherein the emission control transistor includes a gate electrode configured to receive an emission control signal, a first electrode configured to receive the first power supply voltage, and a second electrode electrically connected to the first electrode of the driving transistor.

In the above display, each of the pixel circuits further includes a second initialization transistor including a gate electrode configured to receive the initialization signal, a first electrode configured to receive an initialization voltage, and a second electrode electrically connected to the anode of the OLED. In the above display, each of the pixel circuits further includes a third initialization transistor including a gate electrode configured to receive the initialization signal, a first electrode configured to receive the initialization signal, and a second electrode electrically connected to the first node.

In the above display, the first initialization transistor configured to apply the reference voltage to the second node based at least in part on the initialization signal during a threshold voltage compensation period, wherein the emission control transistor is configured to be turned off during the threshold voltage compensation period such that the first electrode of the driving transistor and the second electrode of the compensation capacitor are electrically disconnected from the first power supply voltage.

In the above display, during the threshold voltage compensation period, the driving transistor is electrically disconnected from the first power supply voltage such that a voltage of the first electrode of the driving transistor is configured to change to the sum of the reference voltage and a threshold voltage of the driving transistor, wherein the compensation capacitor is configured to store the threshold voltage of the driving transistor during the threshold voltage compensation period.

In the above display, the first initialization transistor is configured to apply the reference voltage to the second node based at least in part on the initialization signal during an initialization period, wherein the second initialization transistor is configured to apply the initialization voltage to the anode of the OLED based at least in part on the initialization signal during the initialization period, and wherein the third initialization transistor is configured to apply the reference voltage to the first node based at least in part on the initialization signal during the initialization period.

According to at least one of the disclosed embodiments, the pixel circuit and the OLED display having the same include the driving transistor having the double gate structure. Thus, a voltage deviation of the gate electrode of the driving transistor generated by the ratio between the capacitance of the storage capacitor and the capacitance of the compensation capacitor is not generated. Further, display unevenness generated by a deviation of the characteristics between the storage capacitor and the compensation capacitor according to manufacturing process variations can be decreased and image uniformity can be improved.

DETAILED DESCRIPTION OF CERTAIN INVENTIVE EMBODIMENTS

Although OLED displays have low power consumption, current intensity varies due to variations of the threshold voltage of a driving transistor of the OLED display (i.e., deviation of the difference between a gate voltage and a source voltage of the driving transistor). Variation of the current intensity results in display unevenness.

It is difficult to manufacture transistors within the OLED display to have uniform characteristics because characteristics of the transistors change according to manufacturing process variations.

In typical pixel circuits including a storage capacitor and a compensation capacitor, an end of the storage capacitor and an end of the compensation capacitor are commonly electrically connected to a gate electrode of the driving transistor. Here, a gate voltage of the driving transistor is determined by a ratio between a capacitance of the storage capacitor and a capacitance of the compensation capacitor. Thus, the variation of the threshold voltage of the driving transistor is generated by this ratio.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
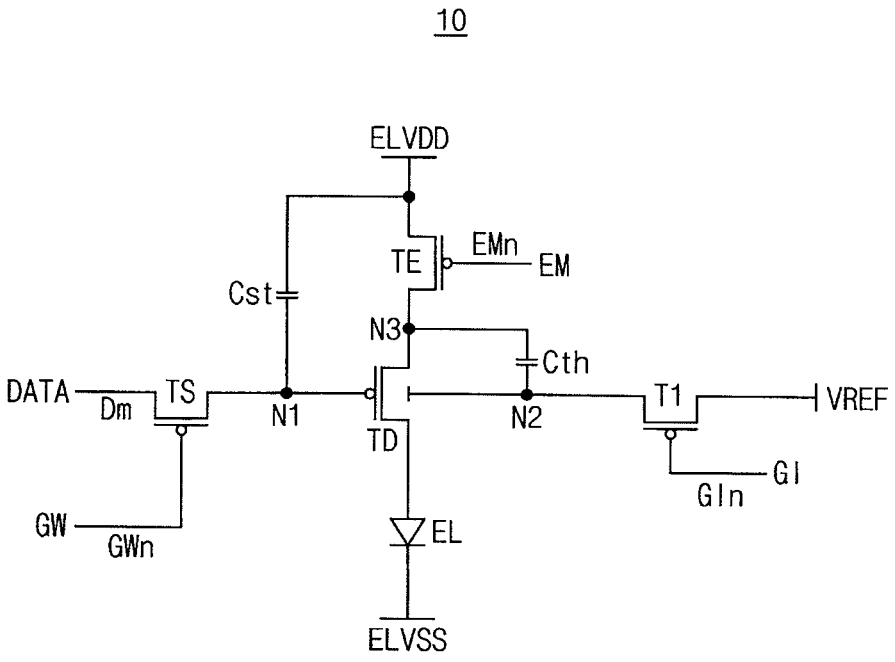
FIG. 1 is a circuit diagram of a pixel circuit according to example embodiments.

FIG. 1 is a circuit diagram of a pixel circuit according to example embodiments.

In the present example embodiment, the pixel circuit can be realized by P-MOS (P-type Metal Oxide Semiconductor) transistors. However, transistors applied in the pixel circuit are not limited thereto.

Referring to FIG. 1, the pixel circuit 10 includes an organic light-emitting diode (OLED) EL, a driving transistor TD, a switching transistor TS, a storage capacitor Cst, and a compensation capacitor Cth. In some embodiments, the pixel circuit 10 further includes an emission control transistor TE and a first initialization transistor T1.

The pixel circuit 10 can receive a first power supply voltage ELVDD, a second power supply voltage ELVSS, an initialization voltage VINIT, and a reference voltage VREF from a power supply unit included in an OLED display.

The pixel circuit 10 can respectively receive a scan signal GW, an initialization signal GI, and a data voltage DATA from a scan line GWn, an initialization line GIn, and a data line Dm. The pixel circuit 10 can receive the first power supply voltage ELVDD and the second power supply voltage ELVSS such that the OLED EL emits light having certain grayscale level corresponding to the data voltage DATA.

The OLED EL includes a cathode electrically connected to the second power supply voltage ELVSS and an anode electrically connected to a second electrode of the driving transistor TD. In addition, the OLED EL can internally include a parasitic capacitor that is generated by the anode and the cathode of the OLED EL.

The driving transistor TD can have a double gate structure. The driving transistor TD can include a first gate electrode electrically connected to a first node N1, a second gate electrode electrically connected to a second node N2, a first electrode electrically connected to a first power supply voltage ELVDD, and a second electrode electrically connected to the anode of the OLED EL. The first gate electrode of the driving transistor TD can correspond to a top gate electrode of the driving transistor TD and the second gate electrode of the driving transistor TD can correspond to a bottom gate electrode of the driving transistor TD. In contrast, the first gate electrode of the driving transistor TD can correspond to a bottom gate electrode of the driving transistor TD and the second gate electrode of the driving transistor TD can correspond to a top gate electrode of the driving transistor TD. A voltage compensating a threshold voltage of the driving transistor TD can be applied to the first gate electrode and the data voltage DATA can be applied to the second gate electrode.

The switching transistor TS can include a gate electrode to which a scan signal GW is applied, a first electrode to which a data voltage DATA is applied, and a second electrode connected to the first node N1. The switching transistor TS can provide the data voltage DATA to the first node N1 based at least in part on the scan signal GW. In some embodiments, the switching transistor TS provides a voltage corresponding to the reference voltage VREF to the first node N1. For example, a voltage applied to the data line DLm is the data voltage DATA or the reference voltage VREF.

The storage capacitor Cst can include a first electrode electrically connected to the first node N1 and a second electrode electrically connected to the first power supply voltage ELVDD. In some embodiments, the storage capacitor Cst stores the data voltage DATA.

The compensation capacitor Cth can include a first electrode electrically connected to the second node N2 and a second electrode electrically connected to the first electrode N3 of the driving transistor TD (i.e., a third node N3 in FIG. 1). In some embodiments, the compensation capacitor Cth stores a voltage corresponding to the threshold voltage of the driving transistor TD.

The first initialization transistor T1 can include a gate electrode to which the initialization signal GI is applied, a first electrode to which the reference voltage VREF is applied, and a second electrode electrically connected to the second node N2. The first initialization transistor T1 can provide the reference voltage VREF to the second node N2 based at least in part on the initialization signal GI. In some embodiments, the reference voltage VREF is less than a voltage difference between the first power supply voltage ELVDD and the threshold voltage of the driving transistor TD.

The emission control transistor TE can be electrically connected between the first power supply voltage ELVDD and the first electrode of the driving transistor TD. The emission control transistor TE can include a gate electrode to which the emission control signal EM is applied, a first electrode to which the first power supply voltage ELVDD is applied, and a second electrode electrically connected to the first electrode N3 of the driving transistor TD (i.e., the third node N3). The emission control transistor TE can be turned on by a turn-on level of the emission control signal EM.

As described below, the pixel circuit 10 according to example embodiments performs a data writing operation at the first gate electrode of the driving transistor TD and performs a threshold voltage compensating operation at the second gate electrode of the driving transistor TD.

Figure 2:
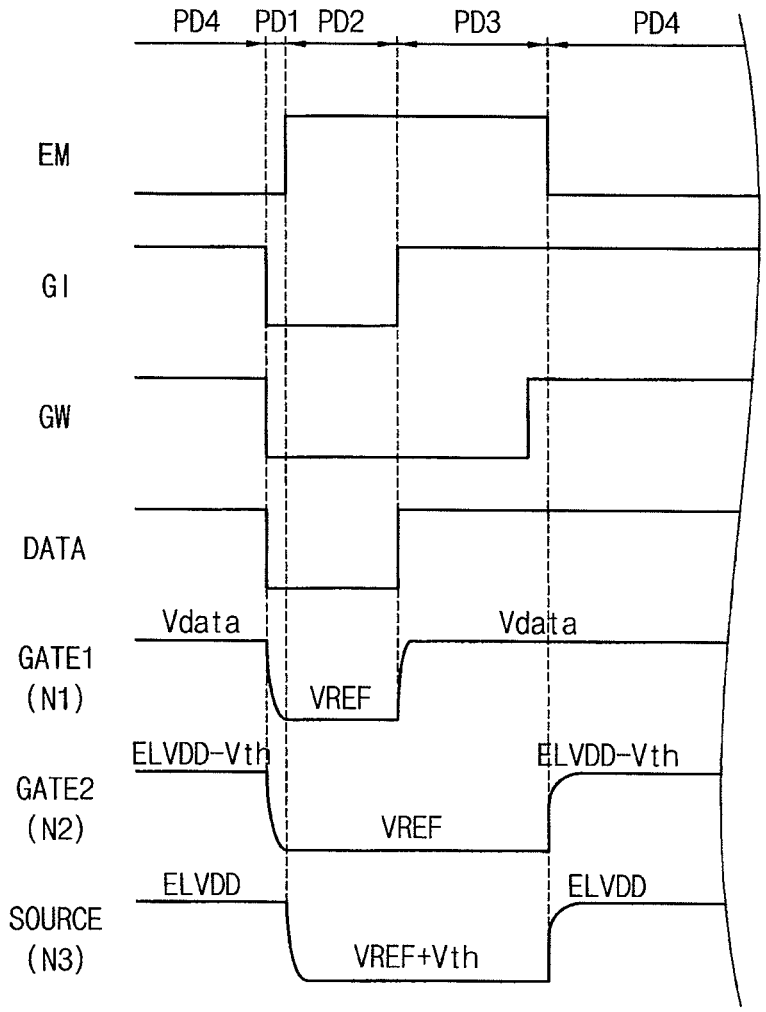
FIG. 2 is a timing diagram illustrating an example of an operation of the pixel circuit of FIG. 1.

FIG. 2 is a timing diagram illustrating an example of an operation of the pixel circuit of FIG. 1.

Referring to FIGS. 1 and 2, one frame period is divided into an initialization period PD1, a threshold voltage compensation period PD2, a data writing period PD3, and an emission period PD4.

During the initialization period PD1, a voltage of the second gate electrode N2 of the driving transistor TD (i.e., GATE2 (N2) represented in FIG. 2) that is included in each of the pixel circuits 10 is initialized. During the initialization period PD1, the first initialization transistor T1 can provide the reference voltage VREF to the second node N2 based at least in part on the initialization signal GI. The switching transistor TS can provide the reference voltage VREF to the first node N1 based at least in part on the scan signal GW during the initialization period PD1. A voltage applied to the data line DLm can correspond to the reference voltage VREF during the initialization period PD1.

The first gate electrode of the driving transistor TD corresponds to the first node N1 and the second gate electrode of the driving transistor TD corresponds to the second node N2.

In some embodiments, during the initialization period PD1, the pixel circuit 10 receives the emission control signal EM having a low level, the initialization signal GI having a low level, and the scan signal GW having a high level.

Therefore, during the initialization period PD1, the first initialization transistor T1 can be turned on such that the second node N2 can be initialized to have the reference voltage VREF. In some embodiments, the reference voltage VREF is set to less than a voltage difference (i.e., ELVDD−Vth represented in FIG. 2) between the first power supply voltage ELVDD and the threshold voltage of the driving transistor TD (i.e., Vth).

Then, during the threshold voltage compensation period PD2, the first initialization transistor T1 can provide the reference voltage VREF to the second node N2 based at least in part on the initialization signal GI. The emission control transistor TE can be turned off during the threshold voltage compensation period PD2 such that the first electrode of the driving transistor TD and the second electrode of the compensation capacitor Cth can be electrically separated from the first power supply voltage ELVDD.

In some embodiments, during the threshold voltage compensation period PD2, the pixel circuit 10 receives the emission control signal EM having a high level, the initialization signal GI having the low level, and the scan signal GW having a low level.

Therefore, during the threshold voltage compensation period PD2, the emission control transistor TE can be turned off, and the switching transistor TS and the first initialization transistor T1 can be turned on. Thus, the first electrode of the driving transistor TD SOURCE represented in FIG. 2) corresponding to the third node N3 can be floated. Therefore, a voltage of the first electrode of the driving transistor TD (i.e., the third node N3) can be discharged during the threshold voltage compensation period PD2. The voltage of the first electrode of the driving transistor TD can be discharged until a voltage difference between the second node N2 (i.e., the second gate electrode of the driving transistor TD) and the first electrode of the driving transistor TD reaches the threshold voltage of the driving transistor TD (i.e., Vth represented in FIG. 2). Thus, the voltage of the first electrode of the driving transistor TD can be changed to a voltage corresponding to a sum of the reference voltage VREF applied at the second node N2 and the threshold voltage of the driving transistor TD (i.e., VREF+Vth). Then, a channel region of the driving transistor TD is closed such that the voltage of first node N1, the voltage of the second node N2, and the voltage of the first electrode N3 of the driving transistor TD (i.e., the voltage of the third node N3) are substantially uniformly maintained during the threshold voltage compensation period PD2.

A voltage difference between the first electrode of the compensation capacitor Cth and the second electrode of the compensation capacitor Cth can correspond to the threshold voltage Vth of the driving transistor TD. Therefore, the threshold voltage Vth of the driving transistor TD can be stored in the compensation capacitor Cth.

Then, during the data writing period PD3, the switching transistor TS can apply the data voltage Vdata to the first node N1 based at least in part on the scan signal GW.

In some embodiments, during the data writing period PD3, the pixel circuit 10 receives the emission control signal EM having the high level, the initialization signal GI having the high level, and the scan signal GW having the low level. In some embodiments, a voltage applied to the data line Dm corresponds to the reference voltage VREF during the initialization period PD1 and the threshold voltage compensation period PD2. The voltage applied to the data line Dm can correspond to the data voltage Vdata during the data writing period PD3.

For example, during the data writing period PD3, the switching transistor is turned on such that the data voltage Vdata is applied to the first node N1. The data voltage Vdata can correspond to a grayscale level to which the OLED EL emits light. Thus, the data voltage Vdata can be stored in the storage capacitor Cst.

As the first electrode N3 of the driving transistor TD is floated, the voltage of the second node N2 can be the reference voltage VREF and the voltage of the first electrode N3 of the driving transistor TD can be the sum of the reference voltage VREF and the threshold voltage of the driving transistor TD (i.e., VREF+Vth).

Thus, a voltage compensating a threshold voltage Vth of the driving transistor TD can be stored in the compensation capacitor electrically connected to the first gate electrode N1 of the driving transistor (i.e., the first node N1). The voltage difference between the first power supply voltage ELVDD and the data voltage Vdata (i.e., ELVDD−Vdata) can be stored in the storage capacitor Cst electrically connected to the second gate electrode N2 of the driving transistor TD (i.e., the second node N2).

During the emission period PD4, the emission control transistor TE can be turned on based at least in part on the emission control signal EM. Thus, the first power supply voltage ELVDD can be applied to the first electrode N3 of the driving transistor TD (i.e., the third node N3). Here, a voltage change of the second node N2 can correspond to a voltage change of the third node N3 (i.e., ΔV) by a coupling of the compensation capacitor Cth. Thus, in the emission period PD4, the second node N2 can have the voltage difference between the first power supply voltage ELVDD and the threshold voltage Vth of the driving transistor TD (i.e., ELVDD−Vth) by the coupling of the compensation capacitor Cth.

In some embodiments, during the emission period PD4, the pixel circuit 10 receives the emission control signal EM having the low level, the initialization signal GI having the high level, and the scan signal GW having the high level.

For example, during the emission period PD4, the voltage change of the second node N2 and the third node N3 are expressed as Equation 1 to Equation 3:

$$VN3=VREF+Vth\rightarrow ELVDD \quad \text{Equation 1}$$

(Here, VN3 denotes the voltage of the third node N3.)

$$\Delta V=ELVDD-(VREF+Vth) \quad \text{Equation 2}$$

(Here, ΔV denotes the voltage change of the third node N3.)

$$\begin{aligned} VN2 &= VREF+\Delta V \\ &= ELVDD-Vth \end{aligned} \quad \text{Equation 3}$$

(Here, VN2 denotes the voltage of the second node N2.)

During the emission period PD4, a current applied to the OLED EL through the driving transistor TD is expressed as Equation 4:

$$\begin{aligned} Ioled &= k/2(Vgs-Vth)\hat{}2 \\ &= k/2\begin{pmatrix} ELVDD-Vth+ \\ Vdata-ELVDD-Vth \end{pmatrix}\hat{}2 \\ &= k/2(Vdata)\hat{}2 \end{aligned} \quad \text{Equation 4}$$

Here, Ioled denotes the current applied to the OLED EL, k denotes a constant value determined by characteristics of the driving transistor TD, and Vgs denotes a voltage between the gate electrode and the source electrode of the driving transistor TD (i.e., a voltage between the first and second gate electrodes and the first electrode of the driving transistor TD).

That is, the current Ioled that flows through the OLED EL is irrelevant to the threshold voltage Vth of driving transistor TD, and is determined only by the data voltage Vdata.

In a typical pixel circuit including a storage capacitor and a compensation capacitor, a gate voltage of a typical driving transistor is determined by a ratio between a capacitance of the storage capacitor and a capacitance of the compensation capacitor.

For example, during the data writing period PD3, the voltage of the gate electrode of the conventional driving transistor is expressed as Equation 5:

$$Vg=(ELVDD-Vth)-(Vdata)*(Cth/(Cst+Cth)) \quad \text{Equation 5}$$

Here, Vgs denotes the voltage of the gate electrode of the typical driving transistor, Vdata denotes the data voltage, and Vth denotes the threshold voltage of the typical driving transistor. Cth denotes the capacitance of the compensation capacitor and Cst denotes the capacitance of the storage capacitor. Thus, the voltage of the gate electrode of the driving transistor depends on the ratio between the capacitance of the storage capacitor and the capacitance of the compensation capacitor.

However, as described above, the pixel circuit 10 according to example embodiments includes the driving transistor TD having the double gate structure. In addition, the first electrode of the storage capacitor Cst is electrically connected to the first gate electrode of the driving transistor TD and the first electrode of the compensation capacitor Cth is electrically connected to the second gate electrode of the driving transistor TD, so that the voltage compensating the threshold voltage of the driving transistor TD and the data voltage Vdata are separately charged at the first gate electrode and the second gate electrode. Thus, a voltage deviation of the gate electrode of the driving transistor generated by the ratio between the capacitance of the storage capacitor and the capacitance of the compensation capacitor is not generated. Further, display unevenness generated by a deviation of the characteristics between the storage capacitor and the compensation capacitor according to manufacturing process variations can be decreased and image uniformity can be improved.

Figure 3:
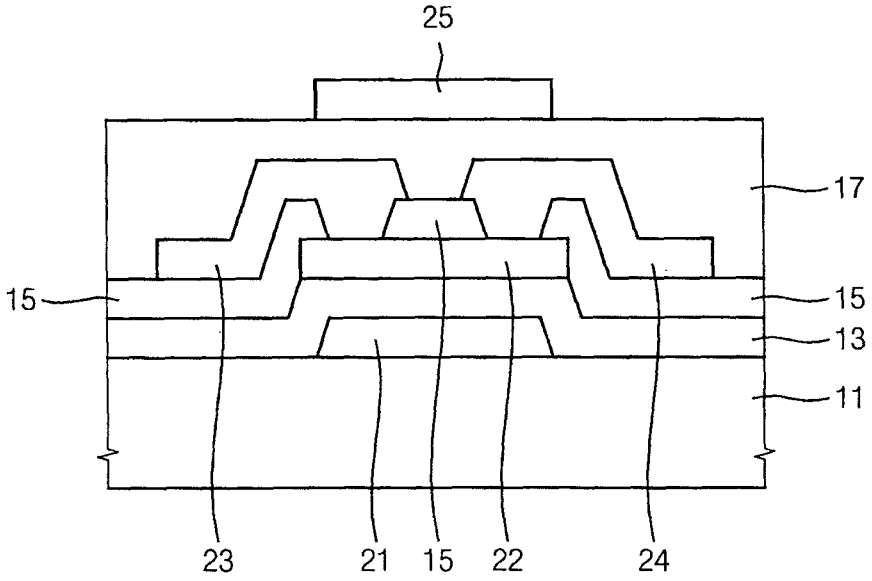
FIG. 3 is a cross-sectional view illustrating an example of a driving transistor included in the pixel circuit of FIG. 1.

FIG. 3 is a cross-sectional view illustrating an example of a driving transistor included in the pixel circuit of FIG. 1.

Referring to FIG. 3, the driving transistor TD includes a bottom gate electrode 21, an active layer 22, first and second electrodes 23 and 24, and a top gate electrode 25. The driving transistor TD has a double gate structure.

In some embodiments, the bottom gate electrode 21 corresponds to the first gate electrode and the top gate electrode 25 corresponds to the second gate electrode. In some embodiments, the bottom gate electrode 21 corresponds to the second gate electrode and the top gate electrode 25 corresponds to the first gate electrode.

For example, the bottom gate electrode 21 is formed on a substrate 11, and a gate insulation layer 13 is formed to at least partially cover the substrate 11 and the bottom gate electrode 21. The substrate 11 can include a glass substrate, a quartz substrate, a transparent resin substrate, etc. The bottom gate electrode 21 can be formed of aluminum (Al), chromium (Cr), Nickel (Ni), Molybdenum (Mo), Tungsten (W), Magnesium (Mg) and/or their alloys. The bottom gate electrode 21 can have a single-layered structure or a multi-layered structure. The gate insulation layer 13 can be formed of silicon oxide (SiOx), silicon nitride (SiNx) or silicon oxynitride (SiOxNy).

The active layer 22 can formed on the gate insulation layer 13 to at least partially overlap the first gate electrode 21. The active layer 22 can be formed of a transparent oxide semiconductor, amorphous silicon, or poly silicon.

The insulation interlayer 15 can be formed on the active layer 22 and the gate insulation layer 13. The insulation interlayer 15 can be formed of silicon oxide (SiOx), silicon nitride (SiNx), silicon oxynitride (SiOxNy), silicon oxycarbonate (SiOxCy), silicon nicarbonate (SiCxNy), aluminum (Al), magnesium (Mg), zinc (Zn), hafnium (Hf), zirconium (Zr), titanium (Ti), tantalum (Ta), aluminum oxide (AlOx), titanium oxide (TiOx), tantalum oxide (TaOx), magnesium oxide (MgOx), zinc oxide (ZnOx), hafnium oxide (HfOx), zirconium oxide (ZrOx) and/or their alloys.

The first and second electrodes 23 and 24 can be formed on the insulation interlayer 15 to be electrically connected to the active layer 22 through a contact hole. In some embodiments, the first and second electrodes 23 and 24 respectively correspond to a source electrode and a drain electrode. The first electrode 23 and the second electrode 24 can be formed of one of molybdenum (Mo), tungsten (W), molybdate tungsten (MoW), aluminum (Al), aluminum-neodymium (Al—Nd), titanium (Ti), titanium nitride (TiN), copper (Cu), molybdenum alloy (Mo alloy), aluminum alloy, and copper alloy.

A planarization layer 17 can be formed on the first electrode 23, the second electrode 24, and the insulation interlayer 15. The planarization layer 17 can be formed of silicon oxide (SiOx), silicon nitride (SiNx) or silicon oxynitride (SiOxNy).

The top gate electrode 27 can be formed on the planarization layer 17 to at least partially overlap the active layer 22. The top gate electrode 27 can be formed of aluminum (Al), chromium (Cr), Nickel (Ni), Molybdenum (Mo), Tungsten (W), Magnesium (Mg) and/or their alloys. The top gate electrode 27 can have a single-layered structure or a multi-layered structure.

Figure 4:
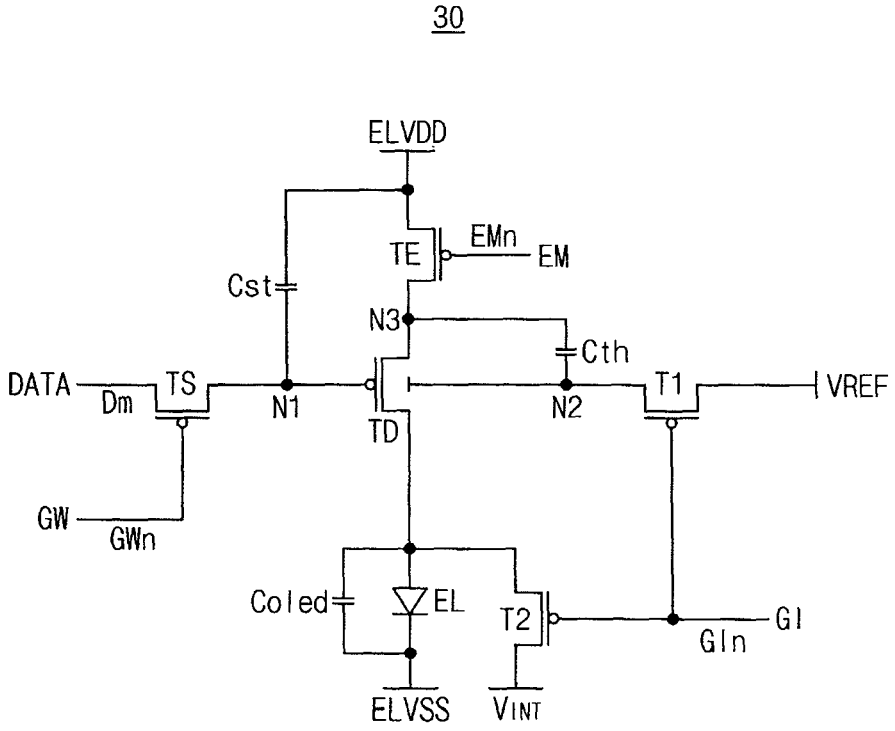
FIG. 4 is a circuit diagram illustrating an example of the pixel circuit of FIG. 1.

FIG. 4 is a circuit diagram illustrating an example of the pixel circuit 10 of FIG. 1.

The pixel circuit of the present example embodiments is substantially the same as the pixel circuit 10 explained with reference to FIGS. 1 and 2 except for a second initialization transistor. Thus, the same reference numerals will be used to refer to the same or like parts as those described in the example embodiments of FIGS. 1 and 2, and any repetitive explanation concerning the above elements will be omitted.

Referring to FIGS. 1, 2, and 4, the pixel circuit 30 includes an OLED EL, a driving transistor TD, a switching transistor TS, a storage capacitor Cst, a compensation capacitor Cth, an emission control transistor TE, and a first initialization transistor T1. The pixel circuit 30 can further include a second initialization transistor T2.

The OLED EL can include a cathode electrically connected to the second power supply voltage ELVSS and an anode electrically connected to a second electrode of the driving transistor TD. In addition, the OLED EL can internally include a parasitic capacitor Coled that is generated by the anode and the cathode of the OLED EL.

The second initialization transistor T2 can include a gate electrode to which the initialization signal GI is applied, a first electrode to which an initialization voltage VINIT is applied, and a second electrode electrically connected to the anode of the OLED EL.

During the initialization period PD1, the second initialization transistor T2 can apply the initialization voltage VINIT to the anode of the OLED EL based at least in part on the initialization signal GI. Thus, a voltage of the anode of OLED EL (i.e., the parasitic capacitor Coled) is initialized to have the initialization voltage VINIT.

Figure 5:
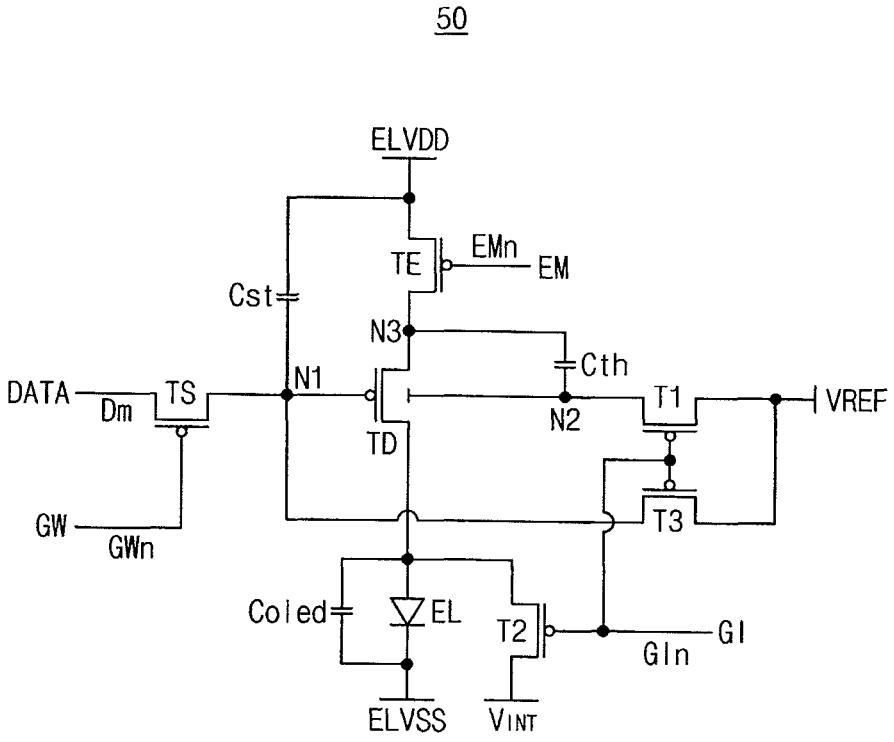
FIG. 5 is a circuit diagram of a pixel circuit according to example embodiments.

FIG. 5 is a circuit diagram of a pixel circuit according to example embodiments.

The pixel circuit of the present example embodiments is substantially the same as the pixel circuit explained with reference to FIGS. 1 and 2 except for constructions of a third initialization transistor. Thus, the same reference numerals will be used to refer to the same or like parts as those described in the example embodiments of FIGS. 1, 2, and 4, and any repetitive explanation concerning the above elements will be omitted.

Referring to FIGS. 1, 4, and 5, the pixel circuit 50 includes an OLED EL, a driving transistor TD, a switching transistor TS, a storage capacitor Cst, a compensation capacitor Cth, an emission control transistor TE, a first initialization transistor T1, and a second initialization transistor T2. The pixel circuit 50 can further include a third initialization transistor T3.

The driving transistor TD can have a double gate structure. The driving transistor TD can include a first gate electrode electrically connected to a first node N1, a second gate electrode electrically connected to a second node N2, a first electrode electrically connected to a first power supply voltage ELVDD, and a second electrode electrically connected to the anode of the OLED EL.

The switching transistor TS can provide the data voltage DATA to the first node N1 based at least in part on the scan signal GW. The emission control transistor TE can be turned on by a turn-on level of the emission control signal EM.

The storage capacitor Cst can store the data voltage DATA. The compensation capacitor Cth can store a voltage corresponding to the threshold voltage of the driving transistor TD.

The first initialization transistor T1 can provide the reference voltage VREF to the second node N2 based at least in part on the initialization signal GI. The second initialization transistor T2 can initialize the anode of the OLED EL based at least in part on the initialization signal GI.

The third initialization transistor T3 can apply the reference voltage VREF to the first node N1 based at least in part on the initialization signal GI during the initialization period. The third initialization transistor T3 can include a gate electrode to which the initialization signal GI, a first electrode to which the reference voltage VREF is applied, and a second electrode connected to the first node N1. In some embodiments, the gate electrode of the third initialization transistor T3 and the gate electrode of the first initialization transistor T1 are commonly electrically connected to an initialization line transmitting the initialization signal GI. Thus, the reference voltage VREF can be substantially simultaneously applied to the first node N1 and the second node N2.

Figure 6:
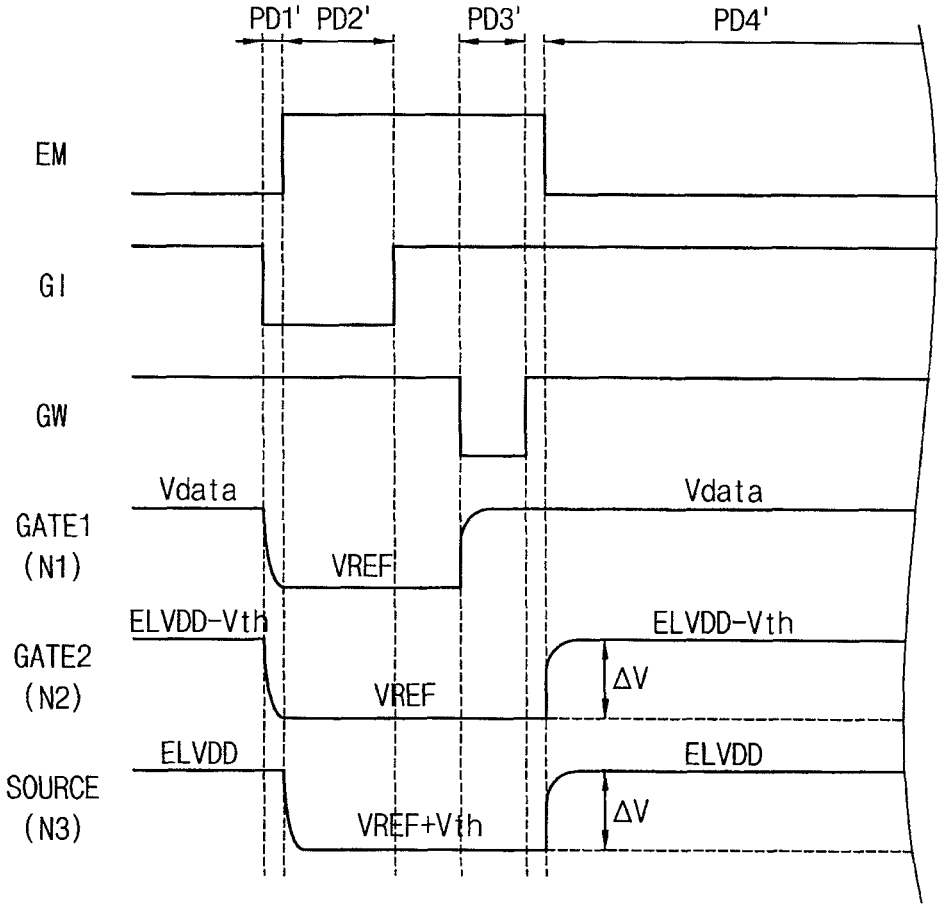
FIG. 6 is a timing diagram illustrating an example of an operation of the pixel circuit of FIG. 5.

FIG. 6 is a timing diagram illustrating an example of an operation of the pixel circuit 50 of FIG. 5.

Referring to FIGS. 5 and 6, one frame period is divided into an initialization period PD1', a threshold voltage compensation period PD2', a data writing period PD3', and an emission period PD4'.

During the initialization period PD1', a voltage of the first gate electrode N1 of the driving transistor TD (i.e., GATE1 (N1) represented in FIG. 6), a voltage of the second gate electrode N2 of the driving transistor TD (i.e., GATE2 (N2)

represented in FIG. 6), and a voltage of the anode of the OLED EL are initialized. The first gate electrode N1 of the driving transistor TD corresponds to the first node N1 and the second gate electrode N2 of the driving transistor TD corresponds to the second node N2.

In some embodiments, during the initialization period PD1', the pixel circuit 50 receives the emission control signal EM having a low level, the initialization signal GI having a low level, and the scan signal GW having a high level.

During the initialization period PD1', the first initialization transistor T1 can be turned on such that the second node N2 can be initialized to have the reference voltage VREF, the third initialization transistor T3 can be turned on such that the first node N1 can be initialized to have the reference voltage VREF, and the second initialization transistor T2 can be turned on such that the anode of the OLED EL can be initialized. In some embodiments, the reference voltage VREF is set to less than a voltage difference (i.e., ELVDD−Vth represented in FIG. 2) between the first power supply voltage ELVDD and the threshold voltage of the driving transistor TD (i.e., Vth).

Then, during the threshold voltage compensation period PD2', the first initialization transistor T1 can provide the reference voltage VREF to the second node N2 based at least in part on the initialization signal GI. The emission control transistor TE can be turned off during the threshold voltage compensation period PD2' such that the first electrode of the driving transistor TD and the second electrode of the compensation capacitor Cth can be electrically separated from the first power supply voltage ELVDD.

In some embodiments, during the threshold voltage compensation period PD2', the pixel circuit 50 receives the emission control signal EM having a high level, the initialization signal GI having the low level, and the scan signal GW having a low level.

During the threshold voltage compensation period PD2', the emission control transistor TE can be turned off. Thus, the first electrode N3 of the driving transistor TD (i.e., SOURCE represented in FIG. 6) corresponding to the third node N3 can float. Therefore, a voltage of the first electrode N3 of the driving transistor TD (i.e., the third node N3) can be discharged during the threshold voltage compensation period PD2'. The voltage of the first electrode N3 of the driving transistor TD can be changed to a voltage corresponding to a sum of the reference voltage VREF applied at the second node N2 and the threshold voltage Vth of the driving transistor TD (i.e., VREF+Vth). Then, a channel region of the driving transistor TD is closed such that the voltage of first node N1, the voltage of the second node N2, and the voltage of the first electrode N3 of the driving transistor TD (i.e., the voltage of the third node N3) are substantially uniformly maintained during the threshold voltage compensation period PD2.

A voltage difference between the first electrode of the compensation capacitor Cth and the second electrode of the compensation capacitor Cth can correspond to the threshold voltage Vth of the driving transistor TD. Therefore, the threshold voltage Vth of the driving transistor TD can be stored in the compensation capacitor Cth.

Then, during the data writing period PD3', the switching transistor TS can apply the data voltage Vdata to the first node N1 based at least in part on the scan signal GW.

In some embodiments, during the data writing period PD3', the pixel circuit 50 receives the emission control signal EM having the high level, the initialization signal GI having the high level, and the scan signal GW having the low level.

As the first electrode N3 of the driving transistor TD is floated, the voltage of the second node N2 can be the reference voltage VREF and the voltage of the first electrode N3 of the driving transistor TD can be the sum of the reference voltage VREF and the threshold voltage of the driving transistor TD (i.e., VREF+Vth).

Thus, a voltage compensating a threshold voltage Vth of the driving transistor TD can be stored in the compensation capacitor electrically connected to the first gate electrode N1 of the driving transistor (i.e., the first node N1). A voltage difference between the first power supply voltage ELVDD and the data voltage Vdata (i.e., the first power supply voltage minus the data voltage, ELVDD−Vdata) can be stored in the storage capacitor Cst electrically connected to the second gate electrode N2 of the driving transistor TD (i.e., the second node N2).

During the emission period PD4, the emission control transistor TE can be turned on based at least in part on the emission control signal EM. Thus, the first power supply voltage ELVDD can be applied to the first electrode N3 of the driving transistor TD (i.e., the third node N3). Here, a voltage change of the second node N2 can correspond to a voltage change of the third node N3 (i.e., ΔV) by a coupling of the compensation capacitor Cth. Thus, in the emission period PD4, the second node N2 can have the voltage difference between the first power supply voltage ELVDD and the threshold voltage Vth of the driving transistor TD (i.e., ELVDD−Vth) by the coupling of the compensation capacitor Cth.

As described above, the pixel circuit 50 according to example embodiments includes the driving transistor TD having the double gate structure. In addition, the first electrode of the storage capacitor Cst is electrically connected to the first gate electrode of the driving transistor TD and the first electrode of the compensation capacitor Cth is electrically connected to the second gate electrode of the driving transistor TD, so that the voltage compensating the threshold voltage of the driving transistor TD and the data voltage Vdata are separately charged at the first gate electrode and the second gate electrode. Thus, a voltage deviation of the gate electrode of the driving transistor generated by the ratio between the capacitance of the storage capacitor and the capacitance of the compensation capacitor is not generated.

Figure 7:
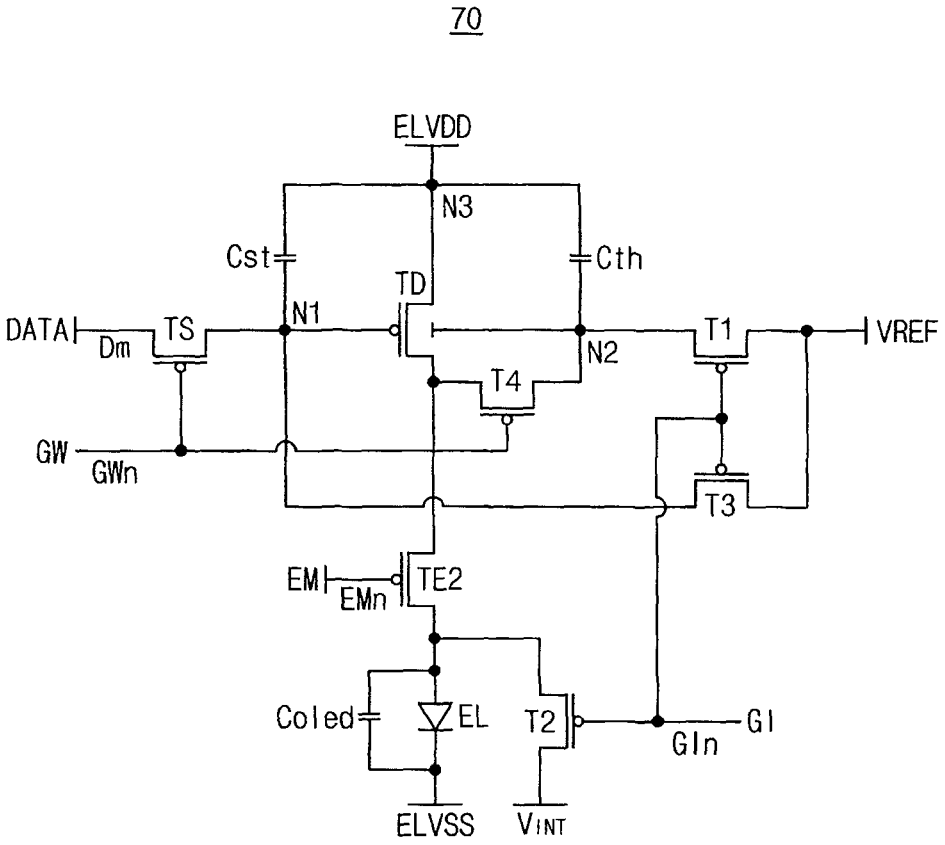
FIG. 7 is a circuit diagram of a pixel circuit according to example embodiments.

FIG. 7 is a circuit diagram of a pixel circuit according to example embodiments.

The pixel circuit of the present example embodiments is substantially the same as the pixel circuit explained with reference to FIGS. 1 and 5 except for constructions of an emission control transistor and a compensation transistor. Thus, the same reference numerals will be used to refer to the same or like parts as those described, and any repetitive explanation concerning the above elements will be omitted.

Referring to FIGS. 1, 5, and 7, the pixel circuit 70 includes an OLED EL, a driving transistor TD, a switching transistor TS, a storage capacitor Cst, a compensation capacitor Cth, an emission control transistor TE2, a first initialization transistor T1, a second initialization transistor T2, and a third initialization transistor T3. The pixel circuit 70 can further include a compensation transistor T4.

The driving transistor TD can have a double gate structure. The driving transistor TD can include a first gate electrode electrically connected to a first node N1, a second gate electrode electrically connected to a second node N2, a first electrode electrically connected to a first power supply voltage ELVDD, and a second electrode electrically connected to the anode of the OLED EL.

The emission control transistor TE2 can be electrically connected between the second electrode of the driving transistor and the anode of the OLED EL. The emission control transistor TE2 can include a gate electrode to which an emission control signal EM is applied, a first electrode electrically connected to the second electrode of the driving transistor TD, and a second electrode electrically connected to the anode of the OLED EL. The emission control transistor TE2 can be turned on by a turn-on level of the emission control signal EM.

The compensation transistor T4 can be turned on based at least in part on the scan signal GW during a data writing period such that the driving transistor TD is diode-connected. The compensation transistor T4 can be electrically connected between the second electrode of the driving transistor TD and the second node N2

When the compensation transistor T4 is turned on, a current pass between the second gate electrode of the driving transistor TD and the second electrode of the driving transistor TD can be formed, and the threshold voltage of the driving transistor TD is compensated. The threshold voltage of the driving transistor can be stored in the compensation capacitor Cth.

Figure 8:
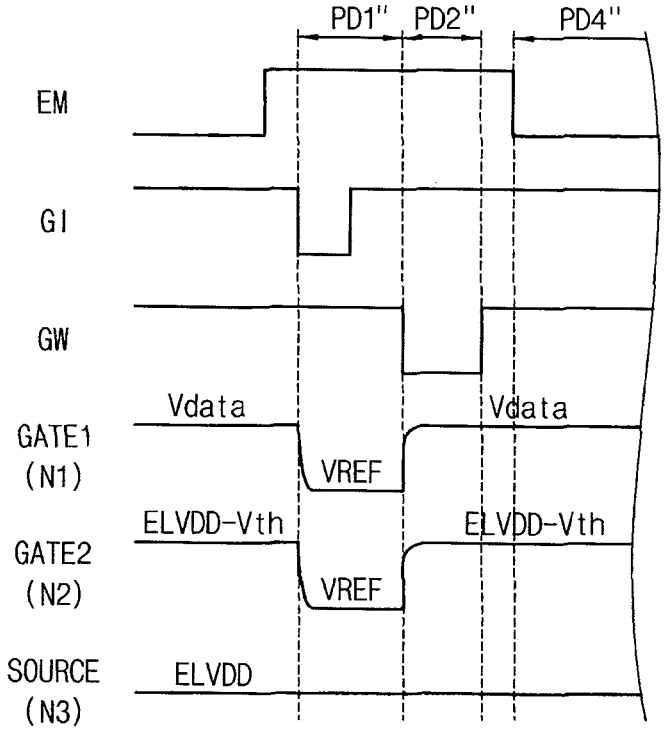
FIG. 8 is a timing diagram illustrating an example of an operation of the pixel circuit of FIG. 7.

FIG. 8 is a timing diagram illustrating an example of an operation of the pixel circuit 70 of FIG. 7.

Referring to FIGS. 7 and 8, one frame period is divided into an initialization period PD1", threshold voltage compensation and data writing period PD2", and an emission period PD4".

During the initialization period PD1", a voltage of the first gate electrode N1 of the driving transistor TD (i.e., GATE1 (N1) represented in FIG. 8), a voltage of the second gate electrode N2 of the driving transistor TD (i.e., GATE2 (N2) represented in FIG. 8), and a voltage of the anode of the OLED EL are initialized. The first gate electrode N1 of the driving transistor TD corresponds to the first node N1 and the second gate electrode N2 of the driving transistor TD corresponds to the second node N2.

During the initialization period PD1", the first initialization transistor T1 can be turned on such that the second node N2 can be initialized to have the reference voltage VREF, the third initialization transistor T3 can be turned on such that the first node N1 can be initialized to have the reference voltage VREF, and the second initialization transistor T2 can be turned on such that the anode of the OLED EL can be initialized.

A data writing operation and a threshold voltage compensating operation can be performed during the same period (i.e., the period PD2"). The data writing operation is implemented at the first node N1 and the threshold voltage compensating operation is implemented at the second node N2.

During the threshold voltage compensation and data writing period PD2", the switching transistor TS can apply the data voltage Vdata to the first node N1 based at least in part on the scan signal GW. The data voltage at the first node N1 can be maintained by the storage capacitor Cst. The driving transistor TD can be turned on by a voltage difference between the first electrode N3 of the driving transistor TD and the first gate electrode of the driving transistor TD.

In addition, during the threshold voltage compensation and data writing period PD2", the compensation transistor T4 can electrically connect the second electrode of the driving transistor to the second node N2 based at least in part on the scan signal GW. For example, the driving transistor TD is diode connected. When the compensation transistor T4 is turned on, the current pass between the second gate electrode of the driving transistor TD and the second electrode of the driving transistor TD can be formed, and the threshold voltage of the driving transistor TD is compensated. Thus, a voltage corresponding to the first power supply voltage ELVDD minus the threshold voltage Vth of the driving transistor TD (i.e., ELVDD−Vth) can be applied to the second gate electrode N2 of the driving transistor TD (i.e., the second node N2). The threshold voltage Vth of the driving transistor can be stored in the compensation capacitor Cth. Thus, the threshold voltage Vth of the driving transistor can be compensated by the diode connection of the driving transistor TD.

During the emission period PD4", the emission control transistor TE2 can be turned on based at least in part on the emission control signal EM. The switching transistor TS, the first to third initialization transistors T1, T2 and T3, and the compensation transistor T4 can be turned off.

During the emission period PD4", the voltage of the first node N1 can correspond to the data voltage Vdata, and the voltage of the second node N2 can correspond to the first power supply voltage ELVDD minus the threshold voltage Vth of the driving transistor TD (i.e., ELVDD−Vth). Thus, a current that flows through the OLED EL is irrelevant to the threshold voltage Vth of driving transistor TD, and is determined only by the data voltage Vdata.

As described above, the data writing operation is implemented at the first node N1 and the threshold voltage compensating operation is implemented at the second node N2. Thus, a voltage deviation of the gate electrode of the driving transistor TD generated by the ratio between the capacitance of the storage capacitor and the capacitance of the compensation capacitor is not generated.

Figure 9:
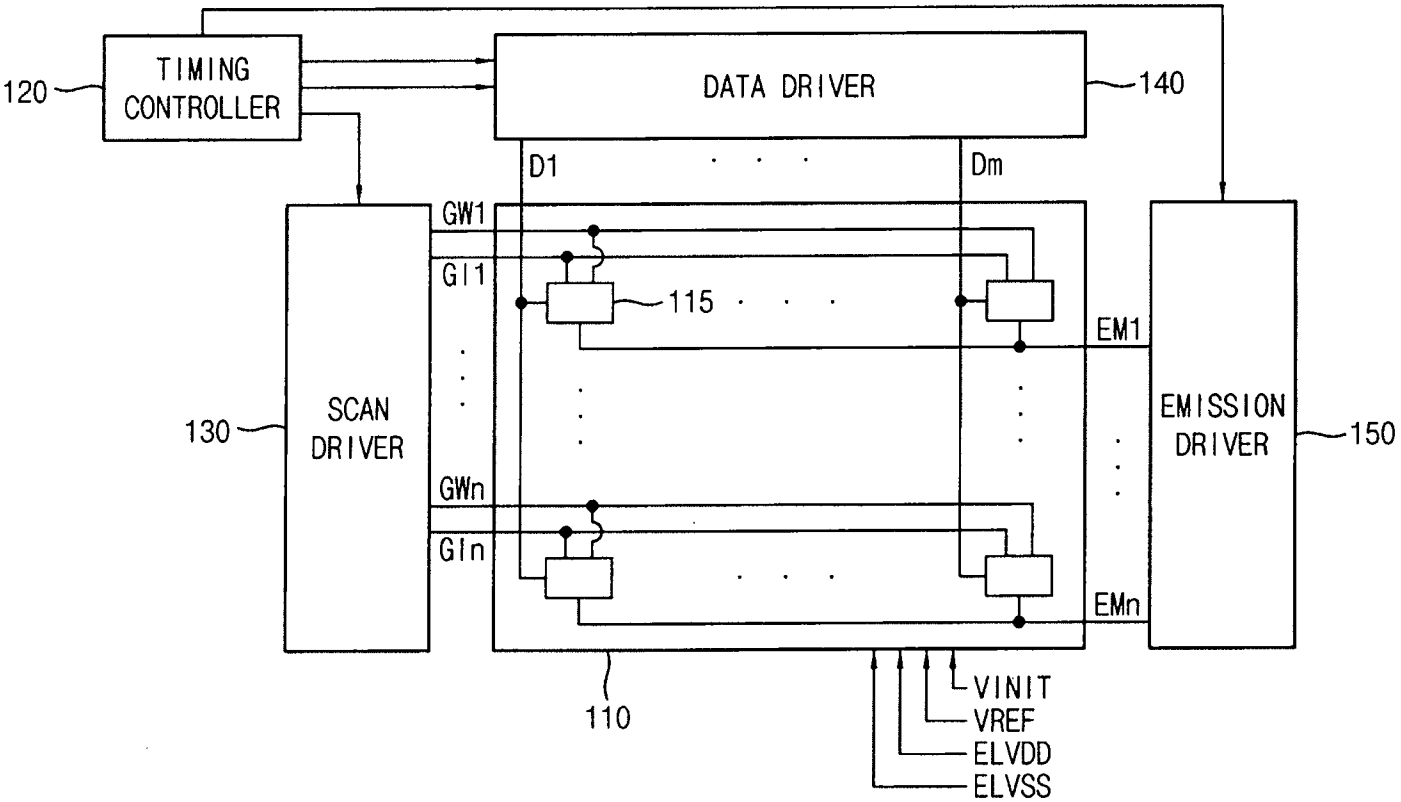
FIG. 9 is a block diagram of an OLED display according to example embodiments.

FIG. 9 is a block diagram of an OLED display according to example embodiments.

Referring to FIG. 9, the OLED display 100 includes a display panel 110, a timing controller 120, a scan driver 130, a data driver 140, and an emission driver 150. The OLED display 100 can further include a power supply unit.

The display panel 110 includes a plurality of data lines D1 to Dm, a plurality of scan lines GW1 to GWn, a plurality of initialization lines GI1 to GIn, a plurality of emission control lines EM1 to EMn, and a plurality of pixel circuits 115. The display panel 110 can receive a first power supply voltage ELVDD, a second power supply voltage ELVSS, an initialization voltage VINIT, and a reference voltage VREF.

In some embodiments, the display panel 110 includes n×m pixel circuits 115 that are placed at crossing points of the scan lines GW1 to GWn, the initialization lines GI1 to GIn, the emission control lines EM1 to EMn, and the data lines D1 to Dm. The pixel circuits 115 can be arranged in a matrix form. As described above, each of the pixel circuits 115 includes an OLED.

The timing controller 120 can generate a plurality of control signals and control the scan driver 130, the data driver 140, the emission driver 150, and the power supply unit based at least in part on the control signals.

The scan driver 130 can respectively apply scan signals to the pixel circuits 115 through the scan lines GW1 to GWn. The scan driver 130 can respectively apply initialization signals to the pixel circuits 115 through the initialization lines GI1 to GIn.

The data driver 140 can respectively apply data voltages to the pixel circuits 115 through the data lines D1 to Dm. In some embodiments, when the pixel circuit of FIGS. 1 to 4 is applied to the OLED display 100, the data driver 140 applies a voltage corresponding to the reference voltage VREF to the data lines D1 to Dm during an initialization period.

The emission driver 150 can respectively apply emission control signals to the pixel circuits 115 through the emission control lines EM1 to EMn.

The power supply unit can apply the first power supply voltage ELVDD, the second power supply voltage ELVSS, the initialization voltage VINIT, and the reference voltage VREF to the pixel circuits 115.

Each of the pixel circuits 115 can receive the scan signal, the initialization signal, the data voltage, the first power supply voltage ELVDD, the second power supply voltage ELVSS, the initialization voltage VINIT, and the reference voltage VREF such that the OLED EL emits light having certain grayscale level corresponding to the data voltage.

The pixel circuits 115 can be one of the pixel circuits of FIGS. 1, 4, 5, and 7.

Each of the pixel circuits 115 can include a driving transistor having a double gate structure, a switching transistor, an emission control transistor, a first initialization transistor, a storage capacitor Cst, and a compensation capacitor Cth. In some embodiments, each of the pixel circuits 115 further includes a second initialization transistor and a third initialization transistor.

The driving transistor TD can have a double gate structure. The driving transistor TD can include a first gate electrode connected to a first node N1, a second gate electrode connected to a second node N2, a first electrode connected to a first power supply voltage ELVDD, and a second electrode connected to the anode of the OLED EL.

The switching transistor TS can provide the data voltage DATA to the first node N1 based at least in part on the scan signal GW. The emission control transistor TE can be turned on by a turn-on level of the emission control signal EM.

The storage capacitor Cst can store the data voltage. The compensation capacitor Cth can store a voltage corresponding to the threshold voltage of the driving transistor TD.

The first initialization transistor T1 can provide the reference voltage VREF to the second node N2 based at least in part on the initialization signal GI. The second initialization transistor T2 can initialize the anode of the OLED EL based at least in part on the initialization signal GI. The third initialization transistor T3 can apply the reference voltage VREF to the first node N1 based at least in part on the initialization signal GI.

As illustrated in FIGS. 1, 4, 5, and 7, the first electrode of the storage capacitor Cst is electrically connected to the first gate electrode of the driving transistor TD and the first electrode of the compensation capacitor Cth is electrically connected to the second gate electrode of the driving transistor TD, so that the voltage compensating the threshold voltage of the driving transistor TD and the data voltage Vdata are separately charged at the first gate electrode and the second gate electrode. Thus, a voltage deviation of the gate electrode of the driving transistor generated by the ratio between the capacitance of the storage capacitor and the capacitance of the compensation capacitor is not generated.

Detailed descriptions about pixel circuit will be omitted because the structure and the operation of the pixel circuits were described referring to FIGS. 1 to 8.

As described above, the OLED display 100 includes the pixel circuit 115 having the driving transistor of the double gate structure. A deviation of the characteristics between the storage capacitor and the compensation capacitor and a deviation of the gate electrode voltage of the driving transistor can be removed. Thus, display unevenness generated by a deviation of the characteristics between the storage capacitor and the compensation capacitor according to manufacturing process variations can be decreased and image uniformity can be improved.

The present embodiments can be applied to any display device and any system including the display device. For example, the present embodiments can be applied to televisions, computer monitors, laptops, digital cameras, cellular phones, a smartphones, smart pads, personal digital assistants (PDA), portable multimedia players (PMP), MP3 players, navigation systems, game consoles, video phones, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A pixel circuit for an organic light-emitting diode (OLED) display, comprising:

an OLED;

a driving transistor having a double gate structure, wherein the driving transistor comprises a first gate electrode electrically connected to a first node, a second gate electrode electrically connected to a second node, a first electrode electrically connected to a first power supply voltage, and a second electrode electrically connected to an anode of the OLED;

a switching transistor including a gate electrode configured to receive a scan signal, a first electrode configured to receive a data voltage, and a second electrode electrically connected to the first node;

a storage capacitor including a first electrode electrically connected to the first node and a second electrode electrically connected to the first power supply voltage;

a compensation capacitor including a first electrode electrically connected to the second node and a second electrode electrically connected to the first electrode of the driving transistor;

a first initialization transistor including a gate electrode configured to receive an initialization signal, a first electrode configured to receive a reference voltage, and a second electrode electrically connected to the second node; and an emission control transistor electrically connected between the first power supply voltage and the first electrode of the driving transistor, wherein the emission control transistor includes a gate electrode configured to receive an emission control signal, a first electrode configured to receive the first power supply voltage, and a second electrode electrically connected to the first electrode of the driving transistor, wherein the first initialization transistor is configured to apply the reference voltage to the second node based at least in part on the initialization signal during a threshold voltage compensation period, wherein the switching transistor is configured to apply a voltage corresponding to the reference voltage to the first node based at least in part on the scan signal during the threshold voltage compensation period, and wherein the emission control transistor is configured to be turned off during the threshold voltage compensation period such that the first electrode of the driving transistor and the second electrode of the compensation capacitor are electrically disconnected from the first power supply voltage.

2. The circuit of claim 1, wherein, during the threshold voltage compensation period, the driving transistor is electrically disconnected from the first power supply voltage such that a voltage of the first electrode of the driving transistor is configured to change to a sum of the reference voltage and a threshold voltage of the driving transistor, and wherein the compensation capacitor is configured to store the threshold voltage of the driving transistor during the threshold voltage compensation period.

3. The circuit of claim 1, wherein the reference voltage is less than a voltage difference between the first power supply voltage and a threshold voltage of the driving transistor.

4. The circuit of claim 1, further comprising a second initialization transistor including a gate electrode configured to receive the initialization signal, a first electrode configured to receive an initialization voltage, and a second electrode electrically connected to the anode of the OLED.

5. The circuit of claim 4, wherein the first initialization transistor is configured to apply the reference voltage to the second node based at least in part on the initialization signal during an initialization period, and wherein the second initialization transistor is configured to apply the initialization voltage to the anode of the OLED based at least in part on the initialization signal during the initialization period.

6. The circuit of claim 4, wherein the switching transistor is configured to apply the reference voltage to the first node based at least in part on the scan signal during the initialization period.

7. The circuit of claim 5, further comprising a third initialization transistor including a gate electrode configured to receive the initialization signal, a first electrode configured to receive the reference voltage, and a second electrode electrically connected to the first node, wherein the third initialization transistor is configured to apply the reference voltage to the first node based at least in part on the initialization signal during the initialization period.

8. The circuit of claim 1, wherein the switching transistor is configured to apply the data voltage to the first node based at least in part on the scan signal during a data writing period.

9. The circuit of claim 1, wherein the emission control transistor is configured to be turned on based at least in part on the emission control signal during an emission period, and wherein the compensation capacitor is configured apply a voltage difference between the first power supply voltage and a threshold voltage of the driving transistor to the second node during the emission period.

10. A pixel circuit for an organic light-emitting diode (OLED) display, comprising:

an OLED;

a driving transistor having a double gate structure, wherein the driving transistor comprises a first gate electrode electrically connected to a first node, a second gate electrode electrically connected to a second node, a first electrode electrically connected to a first power voltage, and a second electrode electrically connected to an anode of the OLED;

a switching transistor including a gate electrode configured to receive a scan signal, a first electrode configured to receive a data voltage, and a second electrode electrically connected to the first node;

a storage capacitor including a first electrode electrically connected to the first node and a second electrode electrically connected to the first power supply voltage;

a compensation capacitor including a first electrode electrically connected to the second node and a second electrode electrically connected to the first electrode of the driving transistor;

an emission control transistor electrically connected between the second electrode of the driving transistor and the anode of the OLED, wherein the emission control transistor includes a gate electrode configured to receive an emission control signal, a first electrode electrically connected to the second electrode of the driving transistor, and a second electrode electrically connected to the anode of the OLED;

a first initialization transistor including a gate electrode configured to receive an initialization signal, a first electrode configured to receive a reference voltage, and a second electrode electrically connected to the second node;

a second initialization transistor including a gate electrode configured to receive the initialization signal, a first electrode configured to receive the reference voltage, and a second electrode electrically connected to the first node; and a compensation transistor electrically connected between the second electrode of the driving transistor and the second node.

11. The circuit of claim 10, wherein the compensation transistor is configured to be turned on based at least in part on the scan signal during a data writing period such that the driving transistor is diode-connected, and wherein the compensation capacitor is configured to store a threshold voltage of the driving transistor during the data writing period.

12. The circuit of claim 10, further comprising a third initialization transistor including a gate electrode configured to receive the initialization signal, a first electrode configured to receive an initialization voltage, and a second electrode electrically connected to the anode of the OLED.

13. An organic light-emitting diode (OLED) display, comprising:

a display panel including a plurality of pixel circuits;

a scan driver configured to apply a scan signal and an initialization signal to the display panel;

a data driver configured to apply a data voltage to the display panel; and an emission driver configured to apply an emission control signal to the display panel, wherein each pixel circuit of the plurality of pixel circuits includes:

an OLED;

a driving transistor having a double gate structure, wherein the driving transistor comprises a first gate electrode electrically connected to a first node, a second gate electrode electrically connected to a second node, a first electrode electrically connected to a first power supply voltage, and a second electrode electrically connected to an anode of the OLED;

a switching transistor including a gate electrode configured to receive the scan signal, a first electrode configured to receive the data voltage, and a second electrode electrically connected to the first node;

a storage capacitor including a first electrode electrically connected to the first node and a second electrode electrically connected to the first power supply voltage;

a compensation capacitor including a first electrode electrically connected to the second node and a second electrode electrically connected to the first electrode of the driving transistor;

a first initialization transistor including a gate electrode configured to receive the initialization signal, a first electrode configured to receive a reference voltage, and a second electrode electrically connected to the second node; and an emission control transistor electrically connected between the first power supply voltage and the first electrode of the driving transistor, wherein the emission control transistor includes a gate electrode configured to receive the emission control signal, a first electrode configured to receive the first power supply voltage, and a second electrode electrically connected to the first electrode of the driving transistor;

a second initialization transistor including a gate electrode configured to receive the initialization signal, a first electrode configured to receive an initialization voltage, and a second electrode electrically connected to the anode of the OLED; and a third initialization transistor including a gate electrode configured to receive the initialization signal, a first electrode configured to receive the reference voltage, and a second electrode electrically connected to the first node.

14. The display of claim 13, wherein the first initialization transistor configured to apply the reference voltage to the second node based at least in part on the initialization signal during a threshold voltage compensation period, and wherein the emission control transistor is configured to be turned off during the threshold voltage compensation period such that the first electrode of the driving transistor and the second electrode of the compensation capacitor are electrically disconnected from the first power supply voltage.

15. The display of claim 14, wherein, during the threshold voltage compensation period, the driving transistor is electrically disconnected from the first power supply voltage such that a voltage of the first electrode of the driving transistor is configured to change to a sum of the reference voltage and a threshold voltage of the driving transistor, and wherein the compensation capacitor is configured to store the threshold voltage of the driving transistor during the threshold voltage compensation period.

16. The device of claim 13, wherein the first initialization transistor is configured to apply the reference voltage to the second node based at least in part on the initialization signal during an initialization period, wherein the second initialization transistor is configured to apply the initialization voltage to the anode of the OLED based at least in part on the initialization signal during the initialization period, and wherein the third initialization transistor is configured to apply the reference voltage to the first node based at least in part on the initialization signal during the initialization period.

* * * * *